United States Patent [19]

Stresing

[11] 4,275,331

[45] Jun. 23, 1981

[54] FLUORESCENT LAMP UNIT

[75] Inventor: Kurt O. Stresing, East Cleveland, Ohio

[73] Assignee: General Electric Company, Schenectady, N.Y.

[21] Appl. No.: 59,281

[22] Filed: Jul. 20, 1979

[51] Int. Cl.[3] ..... H01J 5/48; H01J 5/50

[52] U.S. Cl. ..... 313/318; 156/580.1; 228/110; 313/218; 337/52 R; 337/209

[58] Field of Search ..... 339/52 R, 209; 228/110; 156/580.1; 313/318, 218

[56] References Cited

U.S. PATENT DOCUMENTS

| | | | |
|---|---|---|---|
| 3,351,884 | 11/1967 | Pistey | 339/52 R |
| 3,384,858 | 5/1968 | Johnson | 339/52 R |
| 3,974,418 | 8/1976 | Fridrich | 339/52 R |
| 4,070,571 | 1/1978 | Robertson et al. | 339/52 R |

*Primary Examiner*—Saxfield Chatmon, Jr.
*Attorney, Agent, or Firm*—Norman C. Fulmer; Lawrence R. Kempton; Philip L. Schlamp

[57] ABSTRACT

A self-contained fluorescent lamp unit, such as the "Bright Stik" type, has a pair of plastic end caps positioned at the ends of the light bulb. A plastic resistor ballast housing strip extends along the bulb and into slots in the end caps. Tabs extend from the end caps and alongside the plastic housing strip. These tabs are ultrasonically welded to the housing strip, thus holding the unit together.

3 Claims, 2 Drawing Figures

FLUORESCENT LAMP UNIT

BACKGROUND OF THE INVENTION

The invention is in the field of self-contained fluorescent lamp units, such as the "Bright Stik" lamp unit.

U.S. Pat. No. 3,996,493 to Davenport and Fridrich, which is incorporated herein by reference, discloses and claims a self-contained fluorescent lamp unit of a type commercially available under the "Bright Stik" trademark, and which comprises an elongated fluorescent lamp bulb, a pair of plastic end caps at the ends of the bulb, and a plastic support member and resistor ballast housing extending alongside the bulb. The ballast housing may extend into slots in the end caps in which the members are adhesively or otherwise attached together.

SUMMARY OF THE INVENTION

Objects of the invention are to provide an improved fluorescent lamp unit, and to reduce the manufacturing cost thereof.

The lamp unit of the invention comprises, briefly and in a preferred embodiment, an elongated fluorescent lamp bulb, a pair of plastic end caps at the ends of the bulb, a plastic support strip-like member extending along the bulb and into slots in the end caps, the end caps being ultrasonically welded to the support member thus holding the unit together. Preferably tabs extend from the end caps and over surface areas of the support member, these tabs being ultrasonically welded to the support member.

DESCRIPTION OF THE PREFERRED EMBODIMENTS

Figure 1:
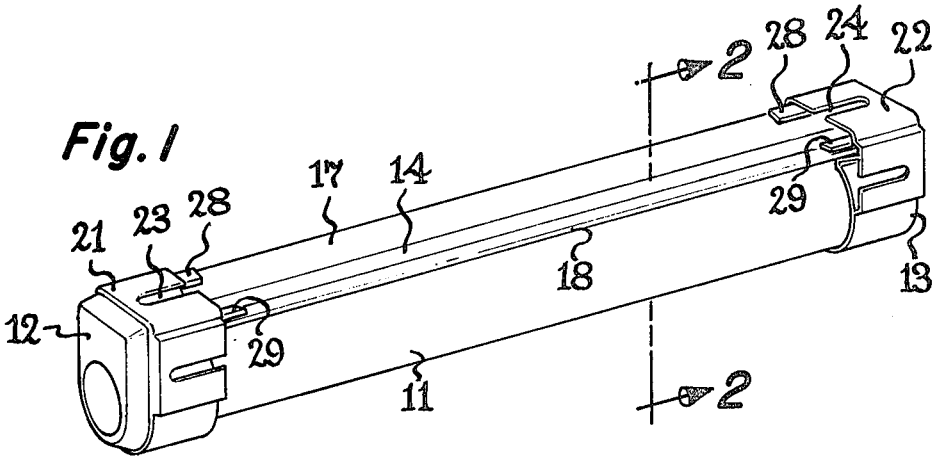
FIG. 1 is a perspective view of a fluorescent lamp unit in accordance with a preferred embodiment of the invention.

The lamp unit comprises an elongated lamp bulb 11, which may be a fluorescent lamp bulb. A pair of plastic end caps 12, 13 are respectively positioned at the ends of the bulb 11; the bulb ends may extend into the end caps. A strip-like support member 14 of plastic extends alongside the bulb 11, and each end of member 14 extends into a slot 16 provided in each of the end caps. Preferably the side portions of the support member 14 extend away from the bulb 11 in the form of wings 17, 18, and the slot 16 in each end cap may comprise a pair of slots **16*a*, 16*b* which respectively receive the end regions of the wings 17, 18. The wings 17, 18 may function as a ballast resistor housing, as disclosed in the above-referenced Davenport and Fridrich patent. Also as is disclosed in the above-referenced patent, an electrical power cord may extend from one of the end caps 12, 13 and a starter switch may be provided in one of the end caps, and the end caps also contain electrical interconnections among the power cord, ballast resistors, starter switch, and filament electrodes in the bulb 11**.

Flat-surface mounting areas 21, 22 aligned with each other may be provided on the sides of the end caps 12, 13, and may contain mounting slots 23, 24, as is disclosed and claimed in U.S. Pat. No. 4,092,562 to Campbell.

Figure 2:
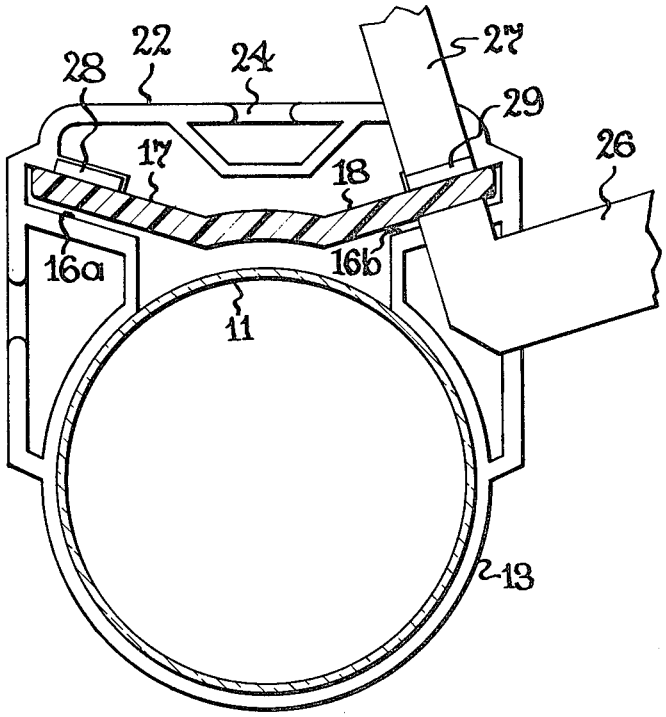
FIG. 2 is a cross-section view taken on the line 2—2 of FIG. 1, and shows a pair of ultrasonic welding electrodes in welding position.

In accordance with the present invention, the end caps 12, 13 are ultrasonically welded to the support strip 14, such as by means of a stationary anvil 26 and an ultrasonically vibrated tool 27 as shown in FIG. 2. Preferably a pair of plastic tabs 28 and 29, which are integral with the end caps 12, 13 extend from each end cap and respectively over surface areas of the wings 17, 18 of the plastic support member 14. These tabs are ultrasonically welded to areas of the wings 17, 18 such as by placing the area of a wing 18 which is opposite the tab 29 over the anvil 26 and bringing the welding tool 27 against the tab 29 and vibrating it at an ultrasonic frequency such as 20 kilohertz to cause the plastic materials of the tab 29 and wing 18 to comingle and lock together, in well known manner. The tabs can thus be welded to the support strip one at a time, or in pairs, or in double pairs, in a very short time, whereupon the support member 14 and end caps 12, 13 are secured together, and the assembly is complete since the end caps 12, 13 hold the lamp bulb 11. The ends of the bulb 11 may be cemented in the end caps with an adhesive, if desired, and no manufacturing time nor clamping together of parts is required while the adhesive cures or hardens.

In a successful embodiment of the invention the end caps and support strip are made of Noryl plastic, the welding tabs are 0.060 inch thick, and the support strip wings are 0.110 inch thick.

The invention achieves the objective of reducing manufacturing cost, due to the economic benefit of securing the lamp unit's parts together quickly and without the need to clamp or hold the end caps and support strip together while an adhesive cures or hardens. The invention also permits adhesive securing of the lamp bulb's ends in the end caps without needing to clamp or hold the parts together and wait for the adhesive to cure, because the ultrasonically bonded end caps and support strip function to hold the lamp bulb and end caps together while the adhesive cures.

While preferred embodiments of the invention have been shown and described, various other embodiments and modifications thereof will become apparent to persons skilled in the art, and will fall within the scope of the invention as defined in the following claims.

What I claim as new and desire to secure by United States Letter Patent is:

1. A lamp unit comprising an elongated lamp bulb, a pair of plastic end caps positioned respectively at the ends of said bulb and each having a groove therein at the inner end thereof whereby said grooves face each other, and a plastic support strip extending alongside said lamp bulb and into said grooves of the end caps, at least one of said end caps being provided with at least one integral tab extending toward the other end cap and alongside one or more surface areas of said support strip, said tabs being ultrasonically welded to said support strip.

2. A lamp unit as claimed in claim 1, in which said support strip comprises a pair of wings along the length thereof and extending away from said lamp bulb and extending into said slots of the end caps, and two of said tabs extending from each of said end caps and alongside surface areas of said wings, respectively, and ultrasonically welded to said respective wings.

3. A method of making a lamp unit, comprising the steps of providing an elongated lamp bulb, a pair of plastic end caps each having a slot therein, and an elongated plastic support strip, placing said end caps at the respective ends of said bulb with the slots therein facing each other, placing said support strip alongside said bulb with the end regions thereof fitting into said slots, respectively, and comprising the further steps of providing at least one integral tab on one or both of said end caps, said tabs of each end cap facing those of the other end cap and being alongside surface areas of said support strip, and ultrasonically welding said tabs to said support strip.

* * * * *